United States Patent [19]

Hasegawa et al.

[11] 4,343,167

[45] Aug. 10, 1982

[54] ROLLER-DIES-PROCESSING METHOD AND APPARATUS

[75] Inventors: Yoshimichi Hasegawa, Nagoya; Osamu Furuta, Tokai; Jouji Shinta, Tokai; Hideo Nakamura, Tokai, all of Japan

[73] Assignee: Aichi Steel Works Ltd., Aichi, Japan

[21] Appl. No.: 253,533

[22] Filed: Apr. 13, 1981

Related U.S. Application Data

[62] Division of Ser. No. 967,695, Dec. 8, 1978, Pat. No. 4,283,930.

[30] Foreign Application Priority Data

Dec. 28, 1977 [JP] Japan ..... 52-158482
Jan. 30, 1978 [JP] Japan ..... 53-9129

[51] Int. Cl.[3] ..... B21B 37/08

[52] U.S. Cl. ..... 72/8; 72/21; 72/240

[58] Field of Search ..... 72/8, 11, 16, 17, 21, 72/9, 224, 234, 250, 240, 235, 65, 78

[56] References Cited

U.S. PATENT DOCUMENTS

| | | | |
|---|---|---|---|
| 397,460 | 2/1889 | Fuller | 72/224 |
| 564,302 | 7/1896 | Brightman | 72/235 |
| 1,123,518 | 1/1915 | Gillespie | 72/65 |
| 1,883,205 | 10/1932 | Whitehead | 72/235 |
| 2,168,340 | 8/1939 | Hill | 72/78 |
| 3,526,113 | 9/1970 | McNaugher | 72/8 |
| 4,127,997 | 12/1978 | Quehen | 72/19 |
| 4,141,071 | 2/1979 | Yerkes et al. | 72/8 |

*Primary Examiner*—Francis S. Husar
*Assistant Examiner*—Jonathan L. Scherer
*Attorney, Agent, or Firm*—Browdy and Neimark

[57] ABSTRACT

Method for manufacturing long bars, round, square or flat, employing multi-tandem type roller dies mechanism in which each roller gap is controlled by the roller gap adjusting mechanism, and apparatus preferably applicable that method. The apparatus is provided with a plurality sets of roller dies, controllers for outputting a respective target roller gap for each roller dies, roller adjusting mechanisms capable of shifting, in accordance with the commanding signals from servo devices based on the output target roller gap, each roller of each set of roller dies symmetrically about the axial line of the die hole formed by the roller dies, roller position sensors for measuring the respective roller gap in order to feed back the measured results to the servo devices, and a propelling mechanism for imparting a deformable blank propelling force. The apparatus may be additionally provide with a dimension measuring device for, on the outlet side of the last set of roller dies, measuring the sectional dimension of the processed bar for permitting rectification of the roller gap of the roller dies by feeding back the measured results. The apparatus may be further added a traveling amount measuring device for measuring the traveling amount in the longitudinal direction of the processed bar for being able to gradually vary the roller gap of the roller dies in response to the traveling amount measured, by which the apparatus can be utilized for the manufacturing of tapered bars.

23 Claims, 17 Drawing Figures

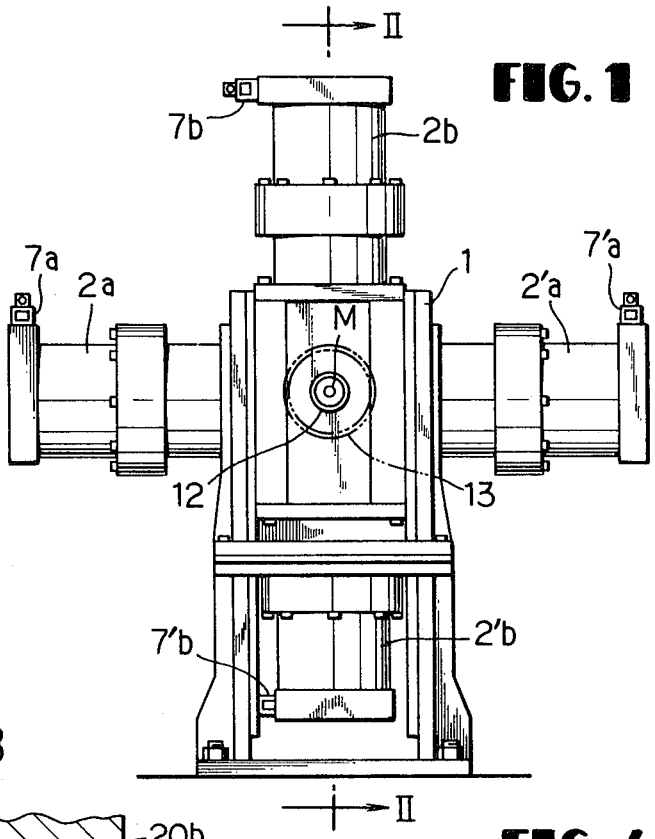
FIG. 1
FIG. 3
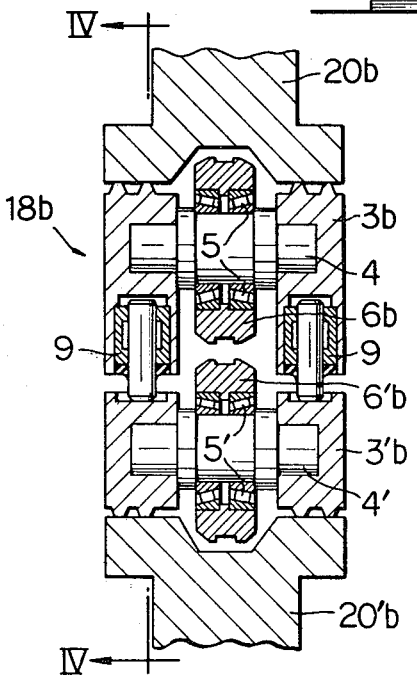
FIG. 4
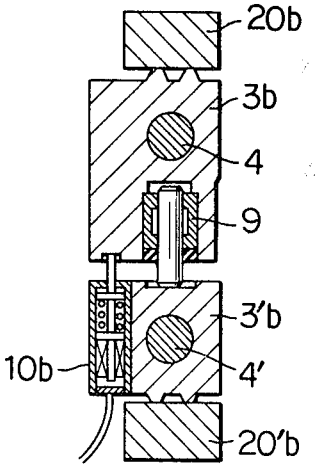

35
36
37
30
29
31
M

ROLLER-DIES-PROCESSING METHOD AND APPARATUS

This is a division of application Ser. No. 967,695, filed Dec. 8, 1978, now U.S. Pat. No. 4,283,930 issued Aug. 18, 1981.

BACKGROUND OF THE INVENTION

The present invention relates to a method, and an apparatus desirably practicable therefor, of manufacturing long bars, such as round bars, square bars, and flat bars, with or without tapered portion, by means of a multi-tandem type roller dies means in which the roller gap thereof is controlled by roller adjusting means.

A set of roller dies is usually composed of a plurality of idler rollers disposed in a close approach at the outer periphery of each roller for processing a work through a pass or die hole formed by a concave groove made on the outer periphery of each roller, while the work is given a propelling force by means of a drawing means. This type process employing roller dies is said to be characteristically advantageous in its far lesser frictional resistance and far larger reduction percentage or reduction of area per one pass (for example 40% per one pass) in comparison to the ordinary process using a drawing die.

The multi-tandem type roller dies means having more than one set of such roller dies in succession is widely known as effective in realizing the above-mentioned advantages.

However, the roller dies means of the conventional type has, on one hand, a weak or vulnerable point in its difficulty of adjusting the roller gap. Known remedies for the problem of roller gap adjusting are a disposition of a tapered roller chock for protruding (inserting) or retracting a tapered liner placed between the pair of roller chocks sustaining the rollers, and a disposition of a roller adjusting screw for adjusting the roll position.

In those accessory adjusting devices, equal amounts of adjusting for each roller of each set is said to be difficult, and a possible up- and down fluctuation of axis or center of the pass defined by the concave grooves on the rollers may produce a bending of the works or the processed articles and a hitch in obtaining works of desired shape. Furthermore, adjusting the roller gap while the process is progressing is said to be next to impossible.

In the cold-rolling of thin plate many devices for controlling the roll gap of the rolling mills are proposed, most of which being ones for adjusting the roll gap by the movement of only one roll, not on both sides. Rolling is usually performed by a driver roll or rolls, so the reduction percentage in the process is low, usually less than 10 percent per one pass. It necessitates installation of several sets of rolling mills in succession for getting the desired percentage of reduction, resulting a bulky equipment and high cost.

In the event of incorporating such roll gap adjusting devices into a well known roller dies means, the gap adjusting by means of movement of a roller, only on one side, is liable to cause a shifting of processing center, an axial line of the work processed, bringing about bending of the work and difficulty of finishing the work in desired dimension and shape, which tendency particularly conspicuous in the roller dies because of its large reduction of the area in each pass.

In recent years demand for tapered bars has been increased for the purpose of improving the performance of, and attempting the lightening of, construction materials. In addition, tapered bars of gradually varied diameter have been put into practice, for use as suspension coil springs for vehicle, because of the advantageous feature of variable spring constant in accordance with the load.

A method for manufacturing tapered bars of high dimensional precision in large quantity and on economical basis has never been developed. It is therefore a common practice to produce such tapered bars by machining, irrespective of its poor economy. Mass productive and an economical way of manufacturing tapered bars has been sought in various quarters.

SUMMARY OF THE PRESENT INVENTION

It is therefore a primary object of this invention to provide a method of processing by means of multi-tandem roller dies means for manufacturing long bars in high precision, being prevented from bending and deforming, and an apparatus preferably practicable therefor, wherein the position of each roller is controlled such that the actually measured distance from a certain predetermined level line to each roller of each roller dies will constantly equal to a target distance.

It is another object of this invention to provide a method of processing by means of roller dies further improved, wherein the sectional dimension of the long bars is measured at the outlet or exit side of the last set of roller dies in the above multi-tandem roller dies means for furnishing the measurement data to be utilized for the adjustment of the position of each roller, and an apparatus therefor.

It is still another object of this invention to provide a further improved method and apparatus therefor in achieving either one of the previous two objects, wherein long bars having a tapered portion (hereinafter called tapered bar) which gradually varies in sectional dimension along the longitudinal direction can be produced with high precision by means of measuring the traveling amount in the longitudinal direction of the long bars, determining the target position for each roller from the traveling amount of the long bars and the taper value pre-set, and so controlling the position of each roller as to align with the target position.

The apparatus in accordance with this invention utilized in the production of a long bar from a deformable blank includes:

(a) multi-tandem type roller dies means including at least:

a first set of roller dies, wherein a plurality of idly rotatable rollers having a concave groove on the periphery thereof are disposed in a manner in which they may be mutually moved toward and away from one another in one plane, i.e. in a mutually approachable and departable way, and a second set of roller dies, wherein a plurality of idly rotatable rollers having a concave groove on the periphery thereof are disposed in a manner in which they may be mutually moved toward and away from one another in a plane parallel to said one plane;

(b) propelling means for forwarding said deformable blank in a longitudinal direction;

(c) roller adjusting means for changing position of each roller of each of said roller dies;

(d) controlling means for outputting electric signals indicating a target distance from a predetermined level line to each roller of each of said roller dies;

(e) roller position sensing means capable of sensing, in each of said roller dies, a distance from said predetermined level line to each of said rollers; and (f) servo means capable of comparing an actually measured distance by said roller position sensing means and a target distance output from said controlling means for controlling the position of each roller of each of said roller dies, and of designating said roller adjusting means, so as to make the difference between said measured distance and said target distance equal to zero.

The manufacturing apparatus of this invention can be modified such that a traveling amount measuring means for measuring the traveling amount of the long bar is added, beside the above-mentioned components, and the controlling means is so altered as to output the target distance of each roller of each roller dies, as electric signals, after determing them from the output of the traveling amount measuring means and the taper value pre-set.

The manufacturing apparatus of this invention can be further modified such that sectional dimension measuring means disposed at the outlet side of the last set roller dies of the multi-tandem roller dies means for measuring the sectional dimension of the long bar to feed back the measured data to the controlling means, and the controlling means can adjust at least the target position of each roller of the last set roller dies so that deviation of the sectional dimension measured by the sectional dimension measuring means from the targeted sectional dimension may be minimized.

The method and apparatus therefor of this invention make it possible to continuously produce long bars of high dimensional precision, without bending or deforming, because the roller gap is constantly adjusted by the shifting of each roller of each roller dies, while the process is in progress, against the axial line of the work.

When the roller gap of the roller dies is so adjusted, in the course of the process, so as to minimize the difference between the actually measured sectional dimension and the targeted sectional dimension by measuring the dimension of the long bars processed, accuracy of the long bars can be further enhanced.

When the traveling amount in the longitudinal direction of the long bar is detected or measured, and the roller gap is automatically and gradually varied at a certain variable rate in response to the measured traveling amount, it becomes possible to efficiently, and at low cost, produce tapered bars gradually varying in the sectional dimension in the longitudinal direction, which enables continuous and material saving production of desired tapered bars in mass production and on high economy basis accompanying remarkable improvement of the yield rate or rate of material effectiveness.

BRIEF DESCRIPTION OF THE DRAWINGS

FIG. 1 is an elevational view of an embodiment of an apparatus in accordance with this invention;

FIG. 3 is a cross-section of the essential part taken along the line III—III in FIG. 2;

FIG. 4 is a cross-section of FIG. 3 taken along the line IV—IV;

DETAILED DESCRIPTION OF THE PREFERRED EMBODIMENTS

Hereunder will be deployed detailed description of the preferred embodiments, which are only for example and not for limiting the invention thereto.

Figure 2:
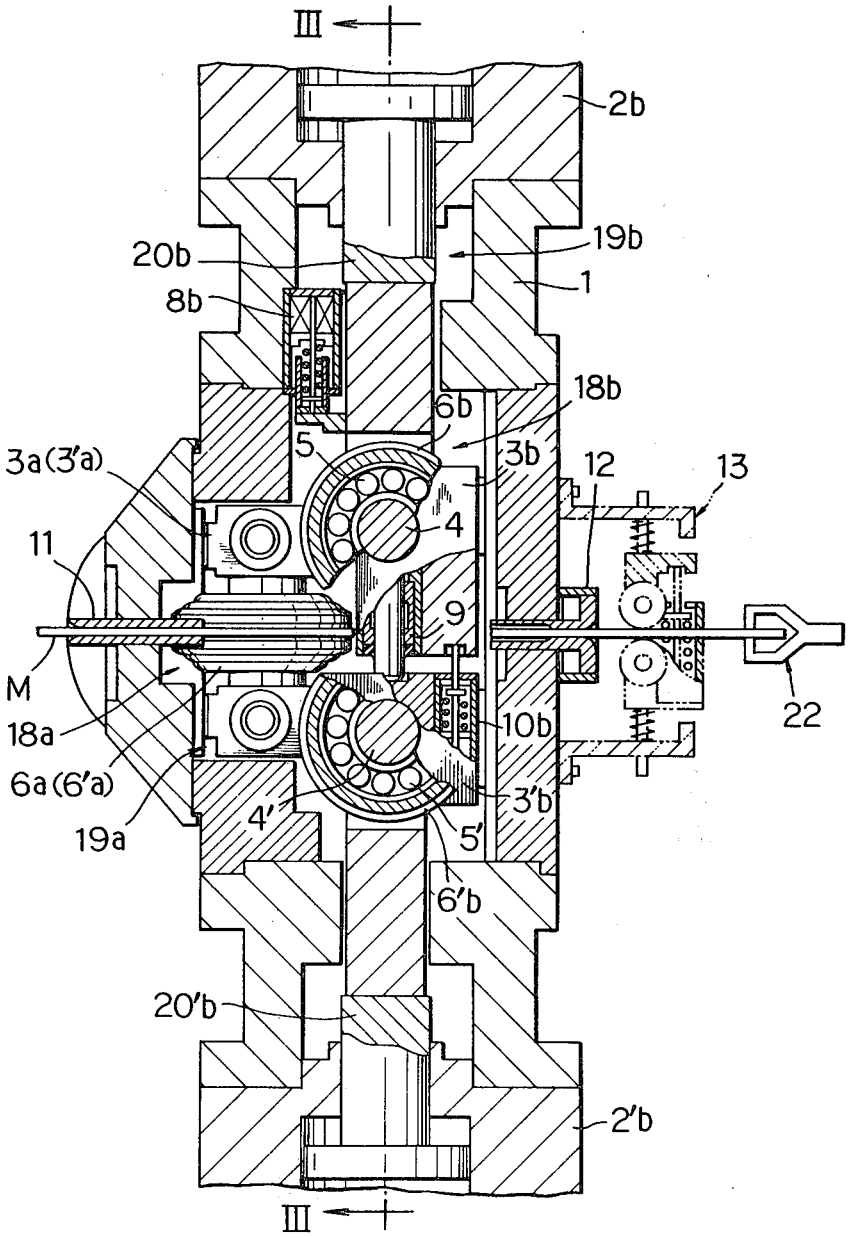
FIG. 2 is a cross-sectional view of the essential part of the apparatus in FIG. 1 taken along the line II—II.

On a frame 1 of the apparatus of this invention are disposed a pair of hydraulic cylinders *2a, 2'a* in a horizontal confrontation to each other, as shown in FIGS. 1 and 2, and another pair of hydraulic cylinders *2b, 2'b* in a vertical confrontation to each other, the two pairs being located in close proximity.

The tip of a piston rod *20b, 20'b* of the vertical hydraulic cylinders *2b, 2'b* abuts respectively on a roller chock *3b, 3'b,* which are retained, respectively in a pair for each roller, by the frame 1 slidably in the vertical direction for non-rotatably holding each end of the roller shaft 4, 4'. About the shaft 4, 4' is, via tapered roller bearings 5, 5', respectively mounted a vertical roller *6b, 6'b* (axis thereof being horizontal) having a groove of semi-circular form in section on the outer periphery thereof. The grooves are positioned in a vertical plane in confrontation for forming a desired pass of circular configuration in section.

Similarly the tip of each piston rod (not shown) of the horizontal hydraulic cylinders *2a, 2'a* abuts respectively on a roller chocks *3a, 3'a* (*3'a* is not shown) for idler rollers *6a, 6'a* (*6'a* is not shown), which are identical in the situation to those in the vertical direction. The pair of horizontal rollers are positioned in mutual confrontation to form together an oval shape pass. A round bar, a work to be rolled, is firstly processed into an oval shape (in section) by means of the horizontal idler rollers *6a, 6'a* and then re-processed through the vertical idler rollers *6b, 6'b* into the desired circular or round section. For the purpose of convenience in explanation a set of roller dies including rollers *6a* and *6'a* disposed upstream from the flow of traveling of the work M will be called the first set of roller dies *18a,* and another set of roller dies including *6b* and *6'b* disposed downstream the flow of the work M will be called the second set of roller dies *18b.*

The hydraulic cylinders 2a, 2'a and the roller chocks 3a, 3'a constitute a roller adjusting mechanism 19a, and similarly the hydraulic cylinders 2b, 2'b and the roller chocks 3b, 3'b constitute another roller adjusting mechanism 19b. As a device of expanding the gap of rollers, contrary to those roller adjusting mechanisms 19a, 19b, there are respectively disposed a pair of hydraulic cylinders 9, as shown in FIGS. 3 and 4, between each pair of roller chocks 3a, 3'a and 3b, 3'b.

In this apparatus is disposed a differential transformer type roller position sensor 8b for measuring the shift amount of the roller 6b, as shown in FIG. 2, between the frame 1 and the roller chock 3b, similarly another differential transformer type roller position sensor 8a is disposed for measuring the shift amount of the roller 6a between the frame 1 and the roller chock 3a (although not shown). Besides, a roller gap sensor 10b is disposed, as shown in FIGS. 2 and 4, between the pair of roller chocks 3b, 3'b. Also in a similar way another not-shown roller gap sensors 10a is disposed between the pair of roller chocks 3a, 3'a. The roller position sensor 8a and the roller gap sensor 10a constitute a roller position sensing device 21a for the first set of roller dies 18a, and the roller position sensor 8b and the roller gap sensor 10b likewise constitute another roller position sensing device 21b for the second set of roller dies 18b.

At the inlet for the deformable blank M (or the work) of this apparatus is disposed an inlet guide 11 of trumpet shape and at the outlet an outlet guide 12. The work M is inserted from the inlet guide 11 for being led through the first and second sets of roller dies to project from the outlet guide 12, for being securely chucked by a drawing mechanism 22 to be given a propelling force in the longitudinal direction.

Figure 5:
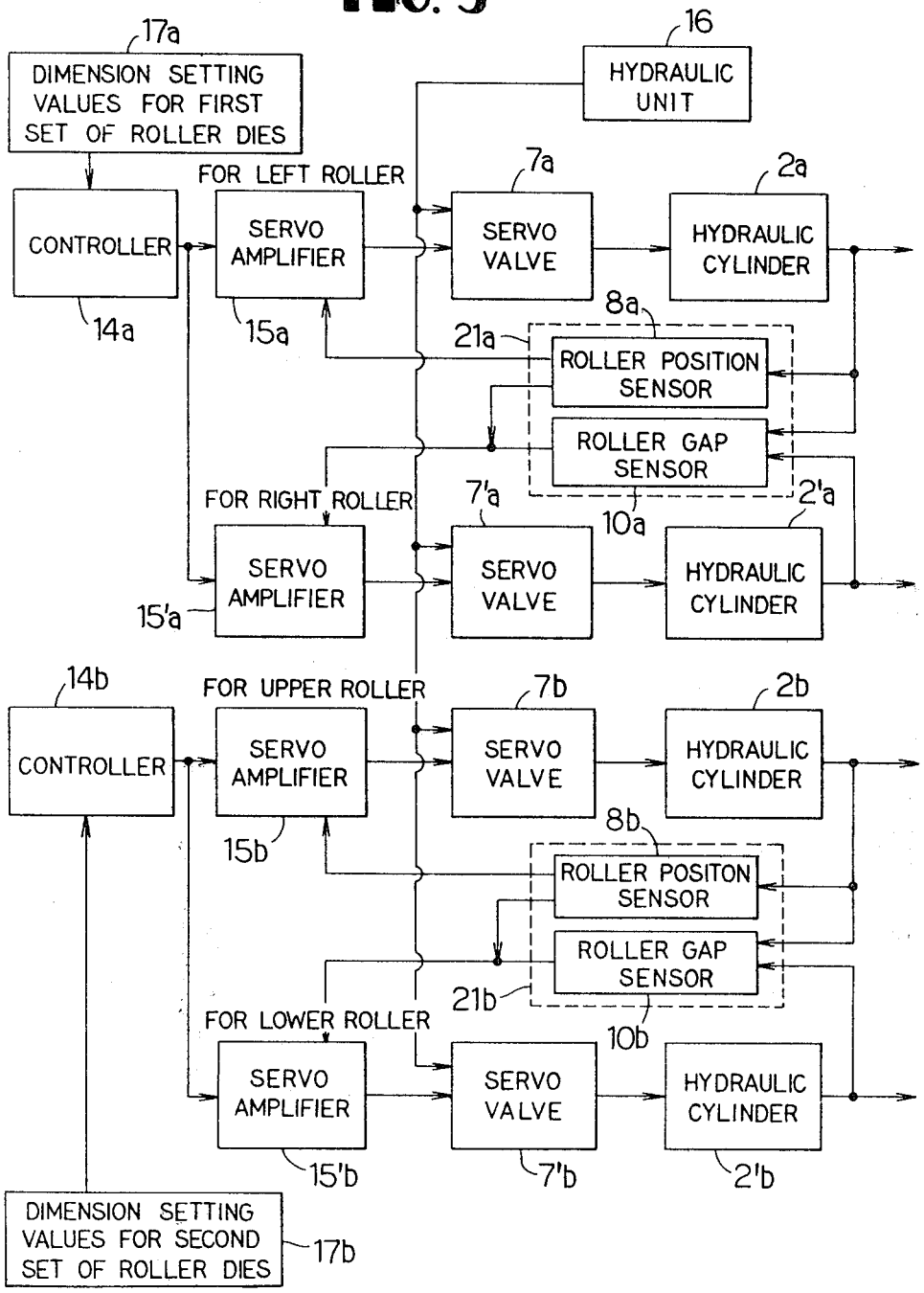
FIG. 5 is a block chart of control means in the apparatus shown in FIGS. 1-4.
Figure 6:
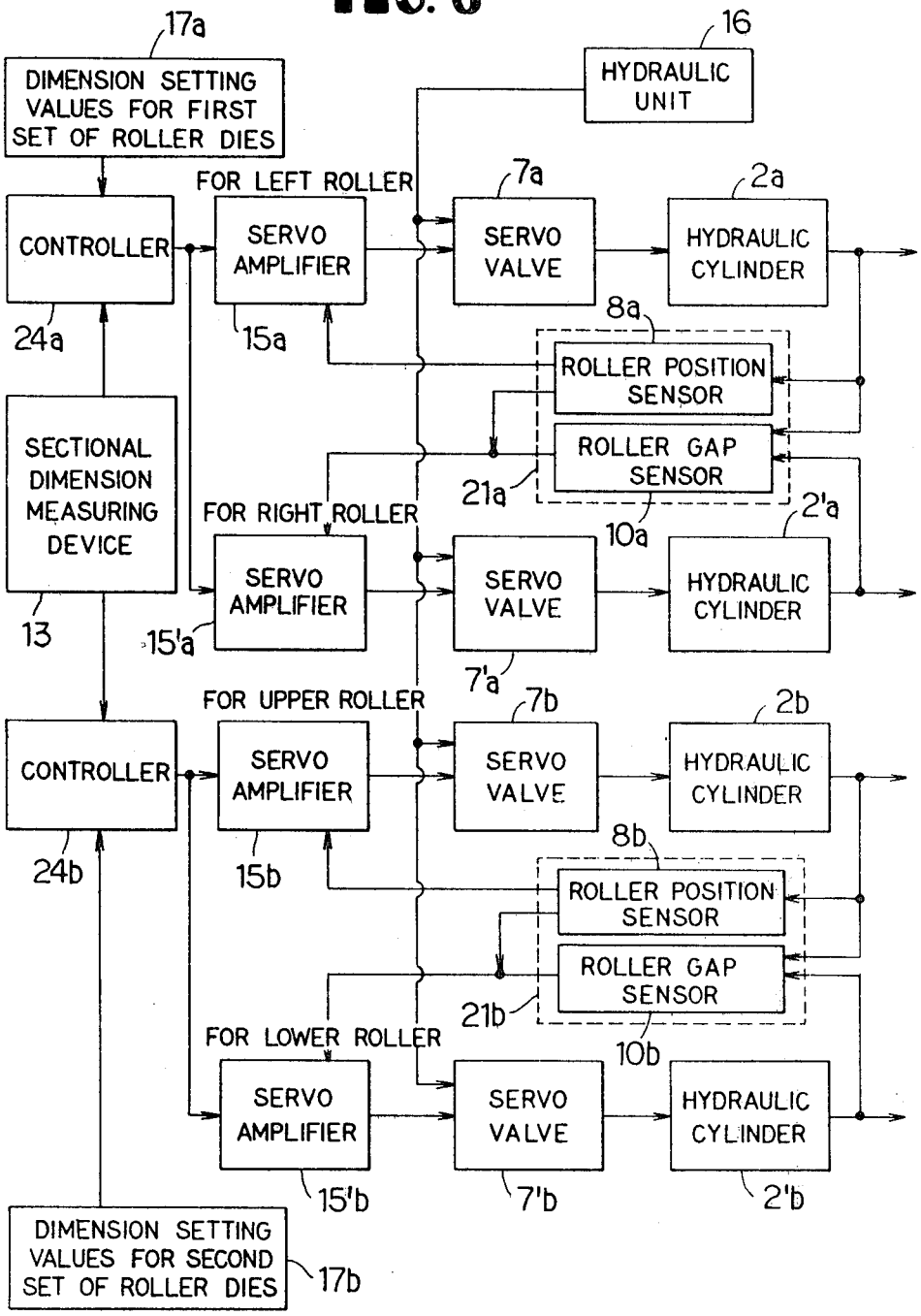
FIG. 6 is a block chart of controlling circuit in a second embodiment of this invention.

The apparatus having such a structure is under the control of a controlling circuit shown in FIG. 5 as a block chart. The hydraulic cylinders 2a, 2'a and 2b, 2'b of the roller adjusting mechanism 19a, 19b are actuated by the oil under pressure coming from a hydraulic unit 16, and the flow of the pressured oil is controlled by a respective controller 14a, 14b as a controlling means and a servo device respectively composed of a servo amplifier 15a, 15'a and 15b, 15'b and a servo valve 7a, 7'a and 7b, 7'b. The first and second sets of roller dies 18a, 18b are thus controlled in respect of the position of the individual roller. Detailed structure of the controlling circuit will be described later together with the operation thereof.

Prior to the starting of the process, the dimension setting values 17a, 17b for the first and second sets of roller dies, which will be the base of the target position for each roller, are set in the controllers 14a, 14b. The dimension setting value is desired to be determined by taking not only the target dimension of the work M but also physical features and temperature of the work M to be rolled, stiffness of the apparatus itself, etc., into consideration.

Before the insertion of the work M into the inlet guide 11, the roller gap of the first and second sets of roller dies 18a, 18b must be widened by the hydraulic cylinder 9 enough to receive the work M therebetween. By making the drawing mechanism 22 chuck the work M at the tip protruded from the outlet guide 12 the process by means of roller dies is ready to start.

While the work M being forwarded by the drawing mechanism 22 the position of each roller of each roller dies is automatically controlled by the commanding signals from the respective controller 14a, 14b, for getting the article, a processed bar, of desired dimension and shape. The controlling operation will be explained by taking the second set of roller dies 18b as an example.

As shown on the lower half of the block chart in FIG. 5, signals for designating the upper roller position (electric signals indicating the target distance from a predetermined level line to the upper roller 6b), which is determined from the roller dies dimension setting value pre-input for the second set of roller dies, are delivered from the controller 14b to the servo amplifier 15b. Likewise to a servo amplifier 15'b is applied signals for the lower roller 6'b positioning from the controller 14b.

The result of the position sensing of the upper roller 6b by a roller position sensor 8b is, on the other hand, fed back to the servo amplifier 15b, and the result of position sensing of the lower roller 6'b by the roller position sensor 8b and the roller gap sensor 10a is fed back to the servo amplifier 15'b. In this embodiment the position of the upper roller 6b is directly sensed or measured by the roller position sensor 8b, and that of the lower roller 6'b is indirectly determined from the position of the upper roller 6b and the roller gap measured by the roller gap sensor 10a. That is because a measurement of the roller gap, which is largely influential to the precision of the finished article, made more precisely than in a case wherein the position of each roller is independently measured.

The servo amplifiers 15b, 15'b determine the difference between the measurement position values of the upper and lower rollers and the target position values of each roller designated from the controller 14b, and then output commanding signals to the servo valves 7b, 7'b for making the difference equal to zero.

The servo valves 7b, 7'b supply as much hydraulic fluid, delivered from the hydraulic unit 16, to the cylinders 2b, 2'b of the upper and lower rollers 6b, 6'b respectively as they have been directed to do, for shifting either roller to the target position.

The controlling operation of the first set of roller dies 18a is totally identical to that of the second set of roller dies 18b, that is the right and left rollers 6a, 6'a can be likewise shifted accurately to the target position.

As described above, either the first and second set of roller dies can be controlled such that the position of roller is shifted by equal amount and may be symmetrically positioned about the axial line of the work M and further the roller gap may be maintained at a desired value, so the articles obtained may be prevented from bending as well as deviating from the precisely pre-set dimensions.

The precision or accuracy of the dimension on the articles can be further enhanced by adding a sectional dimension measuring device 13, shown in FIGS. 1 and 2 with two-dot-chain line, to the above-mentioned manufacturing apparatus.

The sectional dimension measuring device 13 is disposed downstream the outlet guide 12 for measuring the sectional dimension of the work M by touching it from upper and lower sides as well as right and left sides with respective pair of idlly rotatable rollers, which are biased toward each other (in the drawing only vertical rollers shown). The sectional dimension measuring device 13 is so designed as to measure the roller gap in each direction to determine the sectional dimension of the moving work M.

The output from the sectional dimension measuring device 13 is input to each of the controller 24a, 24b.

The controller 24*a*, 24*b* is respectively capable of rectifying the initial setting value of the dimension 17*a*, 17*b* in response to the actually measured dimension, the result of the rectification is output to the servo amplifier 15*a*, 15*b* in the form of electric signals.

In such a manufacturing apparatus desired dimension setting values 17*a*, 17*b* may be input to the controller 24*a*, 24*b* in the initial stage of the processing, regardless of material features and temperature of the work M, stiffness of the roller dies, etc. The dimension setting values 17*a*, 17*b* can be rectified, upon having received the actual dimension measured by the sectional dimension measuring device 13, by feeding back the measurement result to the controller 24*a*, 24*b*. The dimensional precision or accuracy of the articles can be maintained by means of rectification of the setting value 17*a*, 17*b* in such a method, regardless of variation in the peculiar characteristic of the work M and the manufacturing apparatus. It is of course permissible to set, in this instance, initial dimensional setting values 17*a*, 17*b*, which have been applied with some additional consideration based on data presumably determined from the features of the work M and the apparatus itself, and afterwards to rectify the set values upon having received the difference between the thus set values and actually obtained dimension data from the initial stage processing by the dimension measuring device 13. There is no doubt this way of setting dimension setting value assures more precise dimension of the articles.

The experimental data of the drawing process practiced in this embodiment for a round bar is disclosed hereunder as an example:

| | | |
|---|---|---|
| Metal blank: | Spring steel (SAE 9260) bar of diameter | 13 mm |
| Process temperature: | Room temperature | |
| Roller used: | Rollers of diameter of 196 mm | |
| Reduction percentage: | At the first set of roller dies | 25.3% |
| | Summing result of the first and the second set of roller dies | 39.6% |
| Rolling pressure: | At the first set of roller dies | 26.5 ton |
| | At the second set of roller dies | 12.5 ton |
| Drawing velocity: | 15 m/min | |
| Drawing force: | 5.8 ton | |
| Precision of the article in diameter: | ±0.05 mm | |
| Bending of the article: | within 2 mm/meter | |

Another embodiment of this invention will be described, with reference to FIGS. 7–9, to which is added a traveling amount measuring device 23 for measuring the traveling amount in the longitudinal direction of the work M to the previous embodiment illustrated in FIGS. 1–5.

Figure 8:
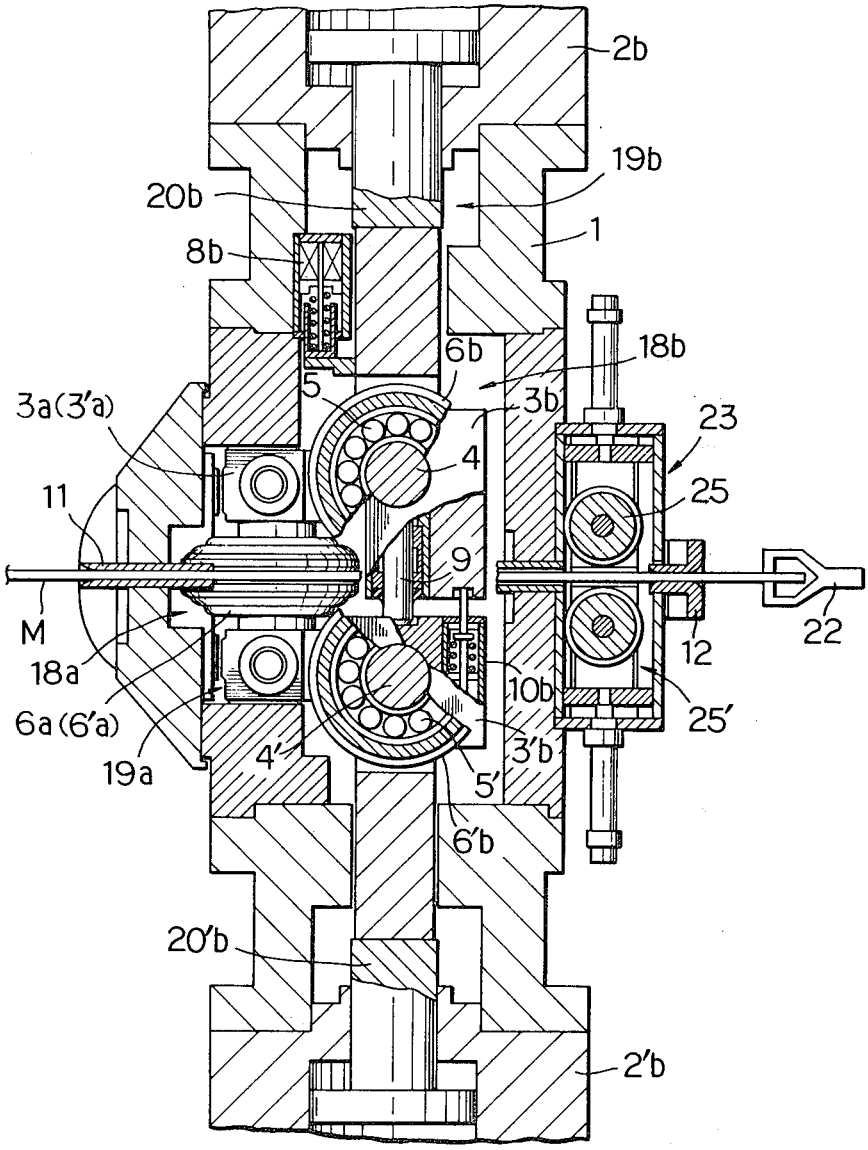
FIG. 8 is a cross-sectional view of the essential part of the apparatus in FIG. 7 taken along the line VIII—VIII.

The traveling amount measuring device 23 is additionally disposed between the second set of roller dies 18*b* and the outlet guide 12, as shown in FIG. 8, being provided with a pair of detecting rollers 25, 25' which touch the work M from upper and lower side, an encoder (not shown) being directly connected to one of the detecting rollers (25) for outputting pulse signals corresponding to the rotating speed thereof, and a traveling amount calculator (not shown) for calculating the traveling amount of the work M in the longitudinal direction from the pulse signals received from the encoder and the diameter of the detecting roller 25.

Figure 9:
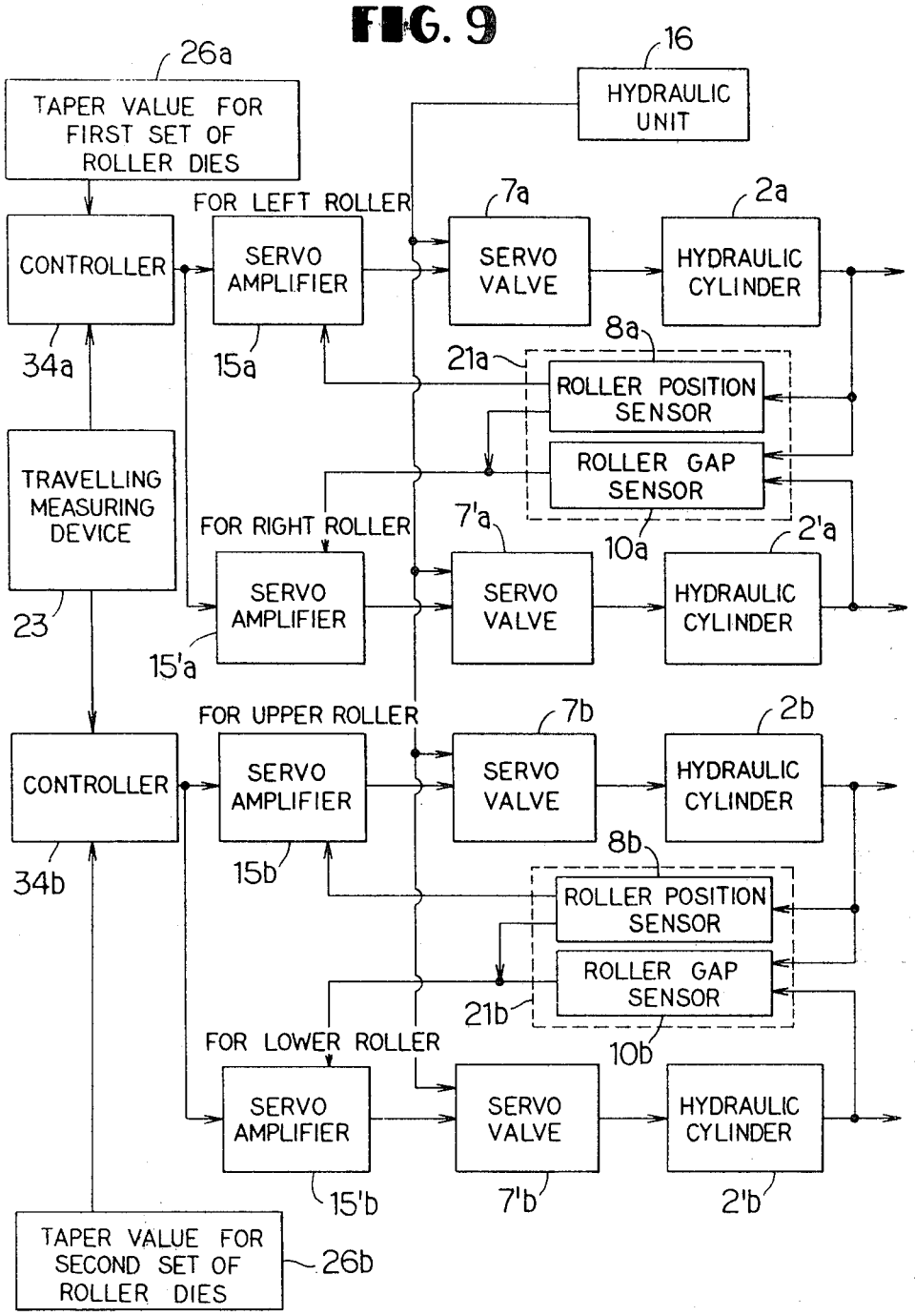
FIG. 9 is a block chart of control means in the apparatus shown in FIGS. 7 and 8.

The traveling amount of the work M measured by the traveling amount measuring device 23 is input to controllers 34*a*, 34*b* shown in FIG. 9, which controllers are so constructed as to be able to output the target position of the rollers, which have been calculated from this traveling amount and the taper value 26*a*, 26*b* for the first and second sets of roller dies 18*a*, 18*b* pre-set, to the servo amplifier 15*a*, 15'*a* and 15*b*, 15'*b*.

Other parts are all similar to the previous embodiment, requiring no lengthy explanation.

Figure 10:
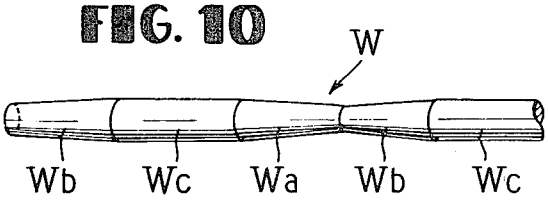
FIG. 10 is a perspective view of an example of a tapered bar manufactured in the apparatus shown in FIGS. 7-9.

According to this embodiment a tapered bar W, like one exemplified in FIG. 10, having a tapered portion Wa where the diameter gradually decreases, a tapered portion Wb where the diameter gradually increases, and a straight portion Wc where the diameter remains constant, sequentially repeated in order, can be processed with high precision. The process and method therefor must be stated next.

Taper value 26*a*, 26*b* is firstly input to the controller 34*a*, 34*b* respectively. The term taper value means to include not only the taper value in the tapered portions Wa, Wb, but also the largest diameter of the tapered portion, i.e., the diameter at the straight portion Wc, the length of the tapered portion, even to the length of the straight portion Wc. The term is used in its broadest sense.

The work M is inserted in this apparatus at its tip portion for being chucked by the drawing mechanism 22. While the work M being forwarded in the longitudinal direction, the traveling amount is measured by the traveling amount measuring device 23 to be input to the controller 34*a*, 34*b* as electric signals (see FIG. 9).

Consequently, the upper roller position signals (electric signals indicating the target distance from the predetermined level line to the upper roller), which is, on the side of the second set of roller dies 18*b*, determined by the taper value 26*b* for the second set of roller dies 18*b* and the output from the traveling amount measuring device 23, are delivered from the controller 34*b* to the servo amplifier 15*b* of the upper roller.

Just likewise to the servo amplifier 15'*b* the lower roller position signals, which is determined by the taper value 26*b* and the output from the traveling amount measuring device 23, are input from the controller 34*b*.

At the same time the measurement result of the roller position sensor 8*b* is input to the servo amplifier 15*b* (see FIG. 9), which is to be compared with the upper roller position signals directed from the controller 34*b*, and the servo amplifier 15*b* sends commanding signals to the servo valve 7*b* so that the difference of the comparison may be made equal to zero.

The measurement results of the roller position sensor 8*b* and the roller gap sensor 10*b* are input to the servo amplifier (see FIG. 9). Upon comparing the input with the lower roller position signals, the servo valve 7'*b* receives the commanding signals from the servo amplifier 15*b* so that the difference may be made equal to zero.

Each servo valves 7*b*, 7'*b* is to supply as much hydraulic fluid, which is delivered from the hydraulic unit 16, as is directed by the commanding signals to the same so as to shift each roller 6*b*, 6'*b* to the target position.

When the work M has traveled further forward, the traveling amount is measured likewise by the traveling amount measuring device 23 and input to the controller 34*b*. A new roller position signal, determined by the traveling amount and setting taper value 26*b*, is delivered from the controller 34*b* to the servo amplifier 15*b*, 15'*b*, the latter sending commanding signal, upon comparing the roller position signal and the actual measurement data of the roller position, respectively to the servo valves 7b, 7'b so that the difference may be equal to zero.

In a totally identical way, as to the first set of roller dies 18a, the taper value 26a for the roller dies and the electric signals from the traveling amount measuring means 23 are input to the controller 34a. The servo amplifier 15a, 15'a compares the roller position signals from the controller 34a and the actual measurement data of the roller position, for sending commanding signals to the servo valves 7a, 7'a so that the difference may be made equal to zero.

While the output from the controller 34a, 34b gradually varies in response to the output from the traveling amount measuring device 23, the tapered portion Wa, Wb in FIG. 10 is processed, and while the output from the controller 34a, 34b does not vary against the output from the traveling amount measuring device 23, the straight portion Wc is processed.

Experimental data of manufacturing a tapered member with this embodiment will be exemplified hereunder.

| | | |
|---|---|---|
| Metal blank: | Spring steel (SAE 9260) bar of diameter | 10 mm |
| Process temperature: | Room temperature | |
| Degree of taper: | 4/1000 (Diameter at the minimum cross-sectional area 7.5 mm) | |
| Reduction percentage: | At the first set of roller dies | Max. 28% |
| | Summing result of the first and the second set of roller dies | Max. 44% |
| Rolling pressure: | At the first roller dies | Max. 12 ton |
| | At the second roller dies | Max. 6 ton |
| Drawing velocity: | 15 m/min. | |
| Drawing force: | Max. 3.5 ton | |
| Precision of the diameter of the article: | ±0.1 mm | |
| Bending of the article: | Within 2 mm/meter | |

Figure 7:
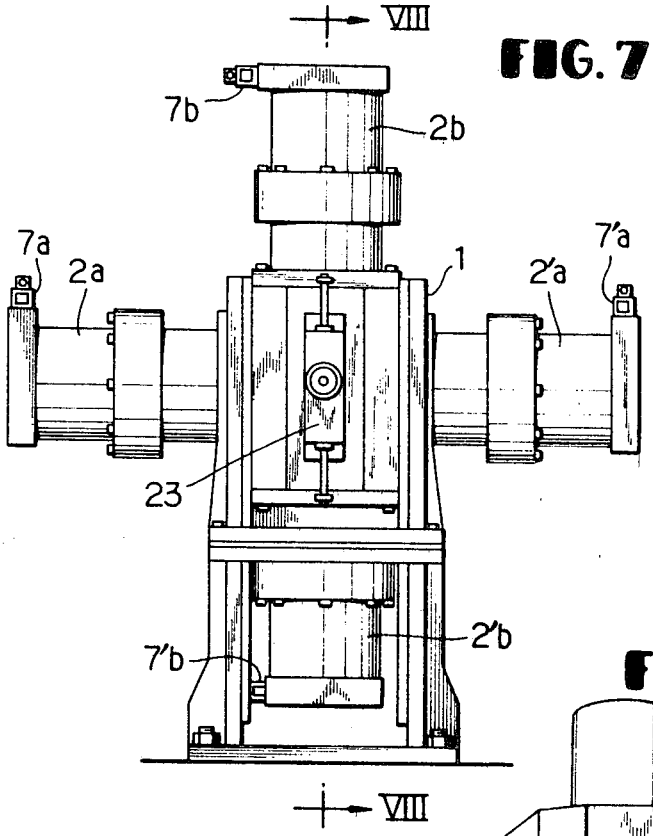
FIG. 7 is an elevational view of a third embodiment of this invention for manufacturing tapered bars.

This invention can be, beside the above described structures, modified in many ways, some of them being illustrated in FIGS. 7–9, wherein the dimension accuracy of the articles, i.e., tapered bars, can be further enhanced.

The processing temperature is not necessarily limited to the room temperature, but the so-called warm process or forming between the range of 400° C.–800° C. is permissible, wherein the roll pressure and thrusting force may be preferably reduced.

It is also possible to additionally mount, on an apparatus for processing long bars, a reforming, sizing or cutting device for performing the operations on line.

Figure 12:
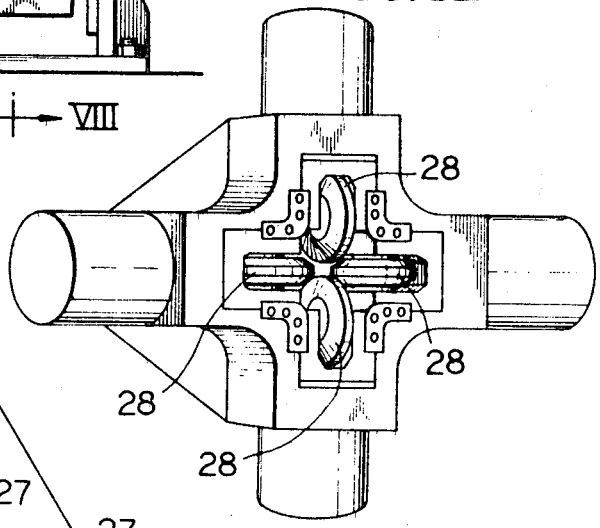
FIG. 12 is a perspective view of the roller dies having four rollers employed in still another embodiment of this invention.
Figure 11:
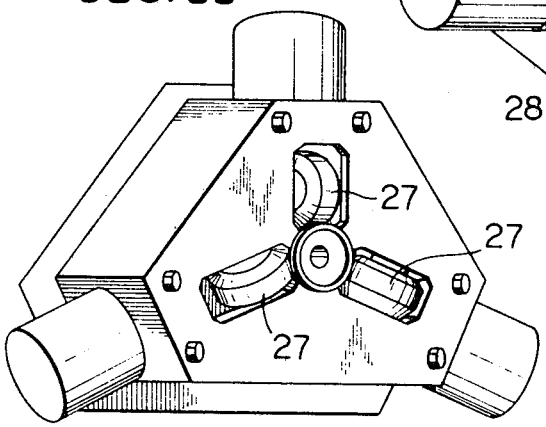
FIG. 11 is a perspective view of the roller dies having three rollers employed in still another embodiment of this invention.

All of the embodiments above described were provided with two sets of roller dies, i.e., being two-tandem type, each set of which has a pair of rollers. Plural tandem type of roller dies means with more than two sets is also permissible. The number of rollers used in a set may be three or four as shown in FIGS. 11 and 12 as numeral 27, 28.

The configuration of the die hole, formed in the roller dies is not limited to oval or circular as in the above embodiments, but it may be of variety. It may be for example a combination of diamond and square; when the hole of the first set be of diamond and that of the second set be of square, it is preferable for obtaining bars of square cross section.

When both die holes are of upright square shape, it is good for forming flat bars of rectangular cross section.

As to the roller adjusting mechanism, the earlier described hydraulic cylinder type mechanism may be replaced by an adjusting screw type ones.

Figures 13, 14, 15, 16, 17:
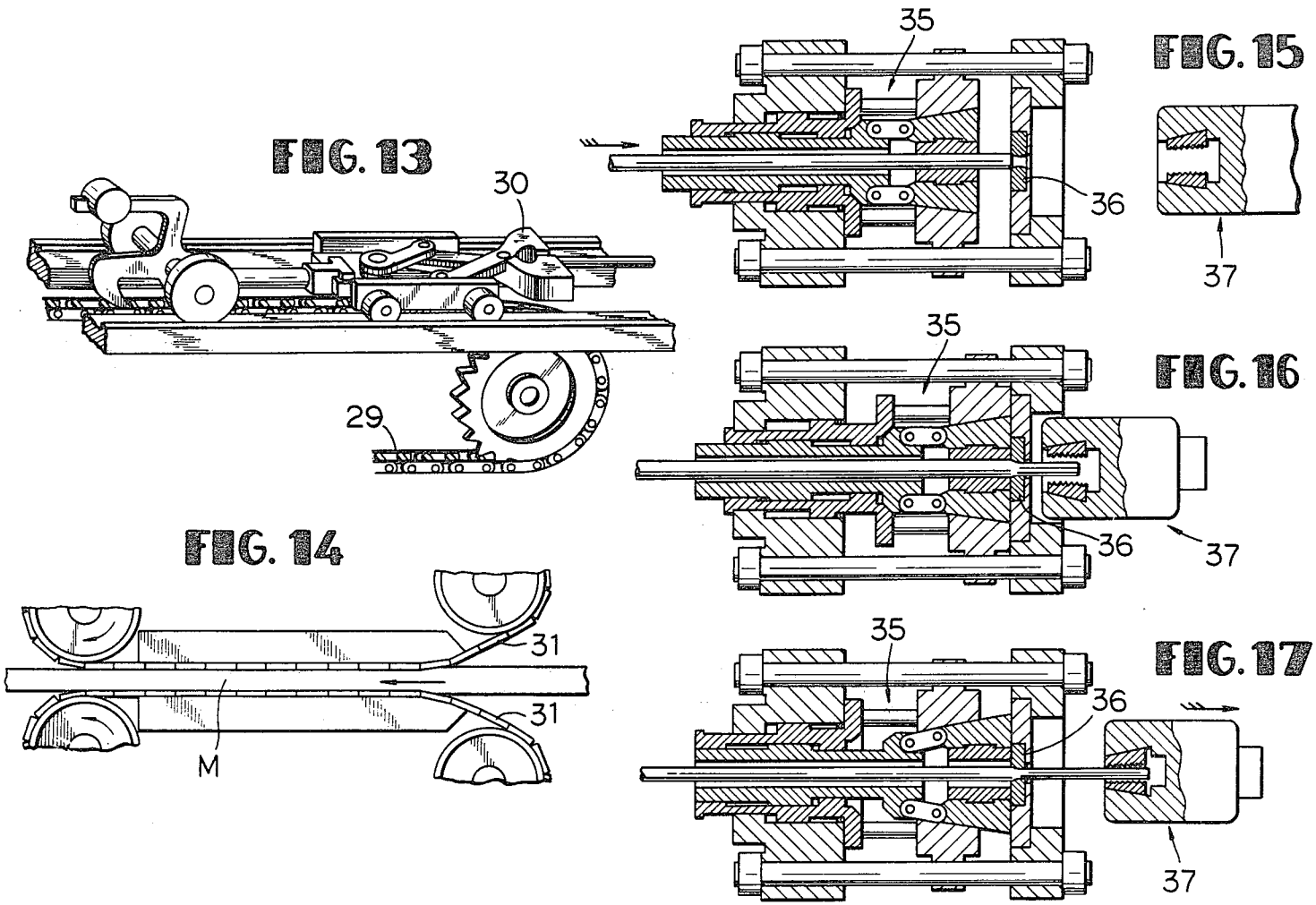
FIG. 13 is a perspective view of a drawing mechanism employed in the apparatus of still another embodiment of this invention.
FIG. 14 is an elevational view of a thrusting mechanism employed in still another embodiment.
FIGS. 15-17 are axial cross-sections of a propelling means composed of a thrusting mechanism and a drawing mechanism employed in still another embodiment in a different operative status respectively.

As to the propelling mechanism, a drawing mechanism shown in FIG. 13 provided with a chuck 30 driven by chain 29, another mechanism shown in FIG. 14, a thrusting mechanism, in which the work M is thrusted into roller dies means by means of a caterpillar 31, and still other mechanisms as shown in FIGS. 15–17 wherein the work M is thrusted into the die 36 (the die 36 must be replaced in case of applying it to this invention to roller dies means) by the thrusting mechanism 35 and when the tip is protruded from the die 36 the drawing means 37 is to take over the propelling operation, are all permissible.

As the roller position sensor or the roller gap sensor, optical or magnetic ones, beside the earlier stated differential transformer type, are also preferably employed.

As the sectional dimension measuring device for the work M, flying micrometer or a thickness sensor by the radiation (radioactive rays), etc. in place of the above thickness sensor by the rollers (during traveling or flowing) is practicable.

As the traveling amount measuring device for the work M, a combination of rollers and tachometer generator in place of the combination of the detecting rollers and the encoder. Another method of employing a non-contacting detector utilizing an image sensor is also good for the purpose.

What is claimed is:

1. An apparatus for manufacturing a long bar from a deformable blank comprising:

(a) multi-tandem type roller dies means including at least a first set of roller dies, wherein a plurality of idly rotatable rollers having a concave groove on the periphery thereof are disposed in a mutually approachable and departable way along a plane through the rotation axes thereof, and a second set of roller dies, wherein a plurality of idly rotatable rollers having a concave groove on the periphery thereof are disposed in a mutually approachable and departable way along a plane through the rotation axes thereof parallel to said one plane;

(b) propelling means for forwarding said deformable blank in a longitudinal direction;

(c) roller adjusting means for changing position of each roller of each of said roller dies;

(d) controlling means for outputting electric signals indicating a target distance from a predetermined level line to each roller of each of said roller dies;

(e) roller position sensing means capable of sensing, in each of said roller dies, a distance from said predetermined level line to each of said rollers; and (f) servo means capable of comparing an actually measured distance by said roller position sensing means and a target distance output from said controlling means for controlling the position of each roller of each of said roller dies, and of designating said roller adjusting means, so as to make the difference between said measured distance and said target distance equal to zero.

2. An apparatus claimed in claim 1, further comprising:

(g) traveling amount measuring means for measuring the traveling amount of said long bar in the longitudinal direction, wherein said controlling means is capable of determining the target distance for each roller of each of said roller dies, from the output of said traveling amount measuring means and a taper value pre-set, for outputting the electric signals indicating said target distance, and wherein said propelling means is a thrusting means disposed on the inlet side of said multi-tandem type roller dies means for thrusting said deformable blank into said multi-tandem type roller dies means.

3. The apparatus claimed in claim 1, wherein said propelling means is composed of a thrusting means, disposed on the inlet side of said multi-tandem type roller dies means for thrusting said deformable blank thereinto, and a drawing means disposed on the outlet side of said multi-tandem type roller dies means for drawing said deformable blank.

4. An apparatus for drawing a deformable blank along a pass line to a straight bar with desired sectional dimension comprising:

(a) multi-tandem type roller dies means including at least two sets of roller dies successively arranged along the pass line in different phase angle, each set of said roller dies including:

a plurality of idler rollers rotatable about axes arranged in a plane perpendicular to the pass line and relatively movable toward and away from each other, each of said idler rollers having a circumferential groove in the periphery thereof with a constant cross-sectional configuration and dimension throughout the whole length thereof to form a size-changeable pass among respective set of said idler rollers, and roller adjusting means for changing position of each of said idler rollers;

(b) drawing means for pulling the deformable blank through the passes of said roller dies means;

(c) controlling means including at least two lines of controlling systems for respectively controlling each set of said roller dies, each line of said controlling system including:

a controller outputing electric signal indicating a target distance from a predetermined level line to each of said rollers, base on a preset constant valve;

roller position sensing means for sensing a distance from said predetermined level line to each of said rollers, and servo means for comparing the actually measured distance by said roller position sensing means and the target distance output from said controller for designating said roller adjusting means so as to make the difference between said measured distance and said target distance equal to zero.

5. An apparatus claimed in claim 4, wherein the distance between (1) a tangential plane passing the circumferential surface of all idler rollers of one of two mutually adjacent sets of said plurality sets of roller dies and (2) the rotational axes of the idler rollers of the other set is less than (3) the radius of each said idler roller of said other set.

6. An apparatus claimed in claim 4, wherein a distance between two planes, in each of which the rotational axes of the idler rollers of two sets mutually adjacent to each other out of said plurality sets of roller dies are arranged, is smaller than the outer diameter of any one idler roller of said two sets.

7. An apparatus claimed in claim 5, wherein said roller dies are disposed by two sets and are compactly built within one frame.

8. An apparatus claimed in claim 7, wherein said roller dies are disposed as two sets, said rollers of each said roller dies are disposed in a pair, the moving direction of the two pairs of rollers being perpendicular to each other.

9. An apparatus claimed in claim 4, further comprising a sectional dimension measuring means, disposed on the outlet side of the last set of said roller dies, for measuring the actual sectional dimension of said straight bar for feeding back the measured results to said controller, wherein said controller is capable of rectifying the target distance of each roller of each of said roller dies so that deviation of the sectional dimension measured by said sectional dimension measuring means from the targeted sectional dimension may be minimized.

10. An apparatus claimed in claim 9, wherein the first size-changeable pass is of substantially oval shape and the second size-changeable pass is of substantially round shape.

11. An apparatus claimed in claim 9, wherein the first size-changeable pass is of substantially diamond shape and the second size-changeable pass is of substantially square shape.

12. An apparatus claimed in claim 4, wherein said rollers of each of said roller dies are disposed in a pair and said roller position sensing means comprises a first position sensor for measuring a distance from said predetermined level line to the axis of one of said rollers in a pair and a second position sensor for measuring a distance between the axes of said rollers in a pair.

13. An apparatus claimed in claim 9, wherein hydraulic cylinders are disposed for expanding the first pass and the second pass.

14. An apparatus claimed in claim 4, wherein said roller dies are disposed as two sets, and each of said roller dies includes three rollers.

15. An apparatus claimed in claim 4, wherein said roller dies are disposed as two sets, and each of said roller dies includes four rollers.

16. An apparatus for drawing a deformable blank along a pass line to a straight bar reduced at least in two directions comprising:

(a) a frame;

(b) two sets of roller dies successively arranged in the travelling direction of said deformable blank with phase angle difference of 90°, each set of said roller dies including:

a pair of hydraulic cylinders fixed to said frame in such a manner that two piston rods of said pair of hydraulic cylinders are coaxially faced to each other, a pair of idler rollers respectively mounted on each of a pair of shafts which are supported by two pairs of chocks and forming a size changeable pass by respective circumferential groove formed on each of said pair of idler rollers, and a pair of biasing cylinders disposed between said two pairs of chocks for biasing each of said two pairs of chocks toward each of said two piston rods;

(c) drawing means for pulling the deformable blank through the passes of said roller dies means; and (d) controlling means including at least two lines of controlling systems for respectively controlling each set of roller dies, each line of said controlling systems comprising:

a controller for outputting electric signal indicating a target distance from a predetermined level line to each of said rollers, based on a preset constant value, roller position sensing means for sensing a distance from said predetermined level line to each of said rollers, and servo means for comparing the actually measured distance output from said controller and for supplying pressurized liquid to each of said hydraulic cylinders so as to make the difference between said measured distance and said target distance equal to zero.

17. An apparatus claimed in claim 16, wherein each of said shafts is unrotatably fixed to each of said two pairs of chocks at both end portions thereof and each of said idler rollers is rotatably mounted on each of said shafts.

18. A method for manufacturing straight bars reduced at least in two directions by drawing using a multi-tandem type roller dies means comprising at least two successively arranged sets of idler rollers in different phase angle, each of said roller sets comprising a plurality of mutually approachable and departable rollers which are provided with a respective circumferential groove having a constant sectional configuration and constant dimension throughout the whole length thereof, said method comprising the following steps:

pulling a deformable blank through the roller sets at a temperature not exceeding 800° C.;

generating by a controller, based on a constant value pre-set, signals respectively representing a target distance of each of said rollers from a predetermined level line;

measuring the actual distance of each roller from the level line;

comparing the target distance and the actual distance and adjusting the position of each roller so that the actual distance is equal to the target distance;

the generation of the output signals representing the target distances, the measuring of the actual distances and the adjusting of the roller positions being performed while drawing is in progress; and the adjusting of the rollers of the plural roller sets being performed so that the passing line of the blank is maintained constant.

19. A method for manufacturing straight bars reduces at least in two directions by drawing using a roller dies apparatus comprising at least two successively arranged sets of idler rollers in different phase angle, each of said roller set comprising a plurality of mutually approachable and departable rollers which are provided with a respective circumferential groove having a constant sectional figure and a constant dimension throughout the whole length thereof, said method comprising the following steps:

widening the roller gap of said roller dies enough to receive the deformable blank at the initial stage of the process;

pulling the blank through the roller sets at a temperature not exceeding 800° C.;

generating by a controller signals respectively representing target distance of each of said rollers from a predetermined level line; said target distance being gradually decreased from a distance corresponding to the roller gap widened at the initial stage to a final distance for manufacturing said straight bars and maintained as said final distance;

measuring the actual distance of each roller from the level line;

comparing the target distance and the actual distance and a adjusting the position of each roller so that the actual distance is equal to the target distance;

the generation of the output signals representing the target distances, the measuring of the actual distances and the adjustments of the roller positions being preformed while drawing is in progress; and the adjusting of the rollers of the plural roller sets being performed so that the passing line of the blank is maintained constant.

20. A method claimed in claim 18, wherein all of said rollers of each of said roller dies are shifted by an equal amount and are always symmetrically positioned about the pass line of said deformable blank.

21. A method claimed in claim 18, further comprising the following steps:

measuring the sectional dimension of the bar on the outlet side of the last set of the roller sets;

feeding back the measured sectional dimension to the controller for rectifying the target distance of each of the rollers; and the measuring of the sectional dimension and the rectifying of the target distances being performed while drawing is in progress.

22. A method claimed in claim 18, wherein said long bar is of circular cross section.

23. A method claimed in claim 18, wherein the thickness of the deformable blank is reduced at least approximately 25% by passage through the first set of idler rollers.

* * * * *